United States Patent [19]

Thurmston

[11] Patent Number: 5,031,881

[45] Date of Patent: Jul. 16, 1991

[54] STAPLE AND TACK EXTRACTOR

[76] Inventor: John Thurmston, 2092 Whitney Pl. N., Clearwater, Fla. 34620

[21] Appl. No.: 455,697

[22] Filed: Dec. 22, 1989

[51] Int. Cl.[5] ..... B25C 11/00

[52] U.S. Cl. ..... 254/28; 254/131

[58] Field of Search ..... 254/21, 25, 28, 18, 254/120, 131

[56] References Cited

U.S. PATENT DOCUMENTS 3,698,689 10/1972 Posken ..... 254/28

4,762,303 8/1988 Thomas ..... 254/25

FOREIGN PATENT DOCUMENTS 76895 2/1918 Switzerland ..... 254/17

*Primary Examiner*—J. J. Hartman

*Attorney, Agent, or Firm*—Joseph C. Mason, Jr.; Ronald E. Smith

[57] ABSTRACT

A hand tool having utility in the extraction of staples, tacks and nails. A thirty degree bend is formed near the distal end of an elongate, rigid shank. The shank widens laterally outwardly distal to the bend, forming a pair of laterally extending wing members that exhibit bilateral symmetry. The shank returns to its original breadth at the distal end of the wings and four parallel claw members extend therefrom. The four claw members are separated by horizontal and vertical slots that divide the claws into a first, upper pair and a second lower pair. The lower pair of claws has a greater longitudinal extent than the upper pair and have a feather edge to facilitate sliding of said lower pair under the crown of a staple. The collective breadth of the lower pair of claws is slightly less than the breadth of a staple so that the crown of the staple is supported at its opposite ends during the extraction procedure.

14 Claims, 1 Drawing Sheet

STAPLE AND TACK EXTRACTOR

TECHNICAL FIELD

This invention relates, generally, to non-motorized hand tools that remove staples, tacks and nails. More particularly, it relates to a device having special utility in extracting staples and other fastening means of the type most often encountered in the furniture upholstery trade.

BACKGROUND ART

Most furniture items are built of assembled parts that are securely fastened together by suitable means; the assembled parts form the frame of the furniture item. Typically, the furniture frame is upholstered, i.e., provided with cushioning springs and covered with padding and fabric. Staples or other fasteners are then driven through the fabric and underlying padding into the frame of the item to thereby improve the appearance of the item while making it more comfortable to the user.

As is well known, springs, padding and fabric often wear out while the underlying furniture frame remains intact. Accordingly, in those situations, the staples or other fasteners are extracted from the frame so that the old springs, padding and fabric may be replaced as needed.

Where the frame is made from a very hard wood, extraction of the fastening means can be a difficult process. A number of inventors have developed hand tools having utility in the extraction of staples, tacks and nails, but such tools have failed at least to some extent in addressing the needs of the upholstery trade.

For example, upholsterers have known for years that the most widely used tool in the industry has significant limitations. However, no one other than the present inventor has been able to create a better tool because the prior art, when considered as a whole, neither teaches nor suggests how the art of extractors could be significantly advanced.

The popular tool mentioned above is shown in U.S. Pat. No. 3,310,288 to Berry. Although the commercial success of that tool has proven its utility, a brief look at its structure and the structure of the common staple will reveal the need for further development in this field of technology.

The common staple includes a pair of parallel, transversely spaced apart leg members that depend to opposite ends of an interconnecting means, known as the crown of the staple, in orthogonal relation thereto; the legs and crown are formed integrally with one another. Persons unskilled in the art of staple extraction will usually attempt the extraction with a tool such as a flat head screwdriver. However, the crown of a staple has an extent greater than the width of a typical screwdriver head; accordingly, as the individual attempts to pry the staple out of the frame, the crown of the staple will always buckle near its center and many times it will break. The individual then has to use pliers to pull the leg members out of the frame, one at a time.

Although such a crude method of staple extraction will eventually result in a removed staple, the limitations of such procedure are numerous. To mention a few, such extraction procedure, being inefficient, takes too much time to be considered as a viable option by a busy professional upholsteror, enlarges the holes where the staple legs had been and thus ruins such locations for future use, and can damage the underlying padding which is undesireable in those situations where only the fabric cover needs to be replaced.

The method employed in using the Berry tool mentioned earlier is an improvement over the screwdriver and pliers method, but staple crowns still buckle and break even when the Berry tool is used. This is because the Berry tool grasps the staple in the center of the crown, as depicted in FIG. 2 of the Berry patent, thereby causing buckling.

Other fastener-extracting tools that have been developed over the years but which have met with less commercial success are shown in Poskin U.S. Pat. No. 3,698,689, Grill et. al., U.S. Pat. No. 4,049,236, Ranck, Sr. U.S. Pat. No. 775, 856, Emery U.S. Pat. No. 2,563,227, Olsen U.S. Pat. No. 664,494, Truman U.S. Pat. No. 450,922, Crofoot U.S. Pat. No. 1,973,846, Beahr U.S. Pat. No. 864,223, Baldwin et. al., U.S. Pat. No. 1,294,600, Cantales U.S. Pat. No. 3,774,252, Cochran U.S. Pat. No. 910,173, De Genova U.S. Pat. No. 2,915,927 Shelton U.S. Pat. No. 2,678,189, Cavanagh U.S. Pat. No. 1,956,166, Settles U.S. Pat. No. 1,949,335 and Seward U.S. Pat. No. 2,212,080.

DISCLOSURE OF INVENTION

The longstanding but heretofore unfulfilled need for an improved extractor for staples and other fastening means is now fulfilled by a claw type extractor having a novel design that precludes breaking of the staple crown, deformation of the hole from which the fastener is extracted, and damaging of the fabric penetrated by the fastener.

The novel hand tool includes a handle and an elongate rigid shaft having a first end secured to the handle and a second end specifically configured and dimensioned to perform staple, tack and nail extraction in a quick, efficient and thus highly productive manner.

The shaft has a gentle bend formed therein near the distal free end thereof. As will become clear as this disclosure proceeds, the bend in the shaft provides a leverage action which facilitates fastener extraction.

The shaft begins to flare laterally outwardly about where the bend is formed, and gradually widens for a predetermined longitudinal extent; it then narrows precipitously to the breadth of its proximal part, and terminates in a highly creative double bifurcation that produces quadruple claw members.

The quadruple claw members are perhaps best understood as a first, upper pair of transversely spaced apart claw members having a first common predetermined longitudinal extent and a second, lower pair of transversely spaced apart claw members having a second common predetermined extent that is greater than the common extent of said first pair of claw members.

The respective leading edges of the lower pair of claw members are characterized by a feather edge that facilitates slipping the lower claws under the crown of the staple or the head of a tack or nail. Importantly, the collective breadth of the lower claws is only slightly less than the breadth of a staple crown. Thus, the crown is supported at its opposite ends by the lower claws during the extraction procedure and as a result cannot buckle or break.

Once the lower claws are fully under the crown, the handle is pressed downwardly and the lower claws begin upward travel, carrying the crown with them, as the shaft is pivoted about the bend formed therein. The crown is displaced upwardly until it encounters the flat lower surface of the upper claws; the upper claws then retain the crown against further movement until the extraction procedure has been completed.

It should therefore be understood that a first bifurcation is along a horizontal plane when the tool is in its operative position; said first bifurcation divides the claws into the just-mentioned upper and lower pair of claws. It should also be understood that a second bifurcation is along a vertical plane when the tool is operatively positioned and that said second bifurcation divides the claws into different pair groupings, i.e., into a first pair of claws having an upper and lower claw and a second pair of claws having an upper and lower claw where said first and second pairs of claws are transversely spaced apart from one another.

The vertical bifurcation creates a vertical slot that extends a greater proximal extent than does the horizontal slot created by the horizontal bifurcation. When a staple is being extracted, the crown of the staple enters the horizontal slot between the upper and lower pairs of claws but the vertical slot is not employed. When the novel tool is used to extract a tack or nail, the shank of the tack or nail enters into the vertical slot and the head thereof at least initially enters into the horizontal slot, all of which will be better understood as this description continues and specific reference is made to the drawings.

Clearly, the invention is new, and useful. Just as clearly, it was not obvious to those of ordinary skill in the art at the time it was made in view of the prior art taken as a whole.

A primary object of this disclosure is to advance the art of fastener extractors by revealing an improved hand tool construction that insures that staples will not break when extracted by the tool, that insures that the holes formed by staple legs will not be enlarged or otherwise deformed during the extraction procedure, and that has the other advantages already mentioned. Other objects and advantages will become apparent hereinafter.

The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
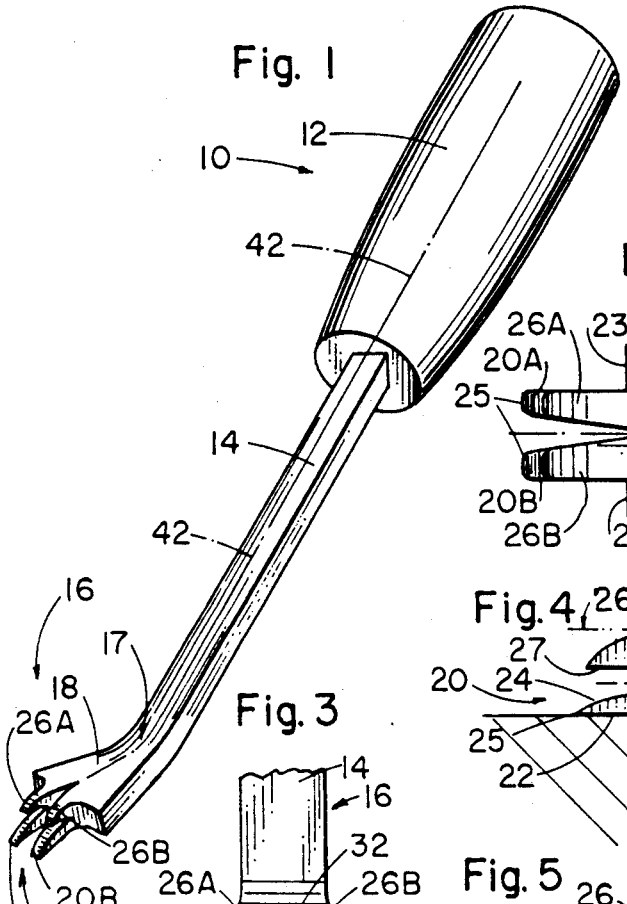
FIG. 1 is a perspective view of an exemplary embodiment of the invention.

Referring now to FIG. 1, it will there be seen that an exemplary embodiment of the invention is denoted as a whole by the reference numeral 10. Tool 10 includes a tapered handle 12 at its proximal end and an elongate, rigid shank 14. The proximal end of the shank 14 is embedded within handle 12 and is fixedly secured therewithin by suitable means. Shank 14 is shown having a substantially square transverse cross section, but it may have any other predetermined geometrical configuration such as round, oval, hexagonal and the like.

The distal free end 16 of shank 14 has a gradual bend 17 formed therein; in a preferred embodiment, the shank is bent about thirty degrees but empirical tests might determine a slightly different optimal angle.

Shank 14 begins flaring laterally upwardly on the distal side of bend 17, thereby forming a pair of symmetrical delta-shaped wing members 18, i.e., wings 18 exhibit bilateral symmetry. The outward flare continues along a predetermined longitudinal extent as at 19 (FIG. 2) and the outward flare terminates in opposite, longitudinally aligned flat edges 21, 21 as shown. A precipitous decrease in shank diameter then occurs as at 23, 23, and that part of the shank distal of wings 18 has a collective breadth substantially equal to the breadth of shank 14 as is clearly shown in FIG. 2.

A lower pair of claws 20 includes transversely spaced apart lower claw members 20A, 20B and an upper pair of claws 26 includes transversely spaced apart claw members 26A, 26B. The lower pair of claws 20 has a greater longitudinal extent than the upper pair of claws as shown in FIG. 4 and several other Figs.

Figure 4:
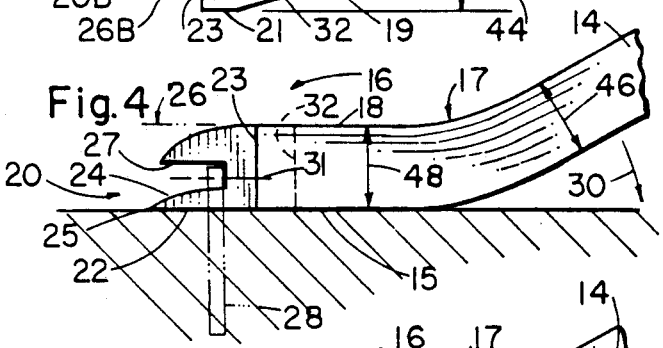
FIG. 4 is a side elevational view of the working tip extracting a staple.
Figure 3:
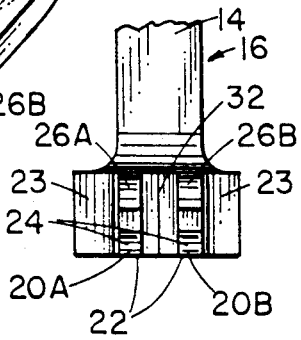
FIG. 3 is a front elevational view of the working tip.
Figure 5:
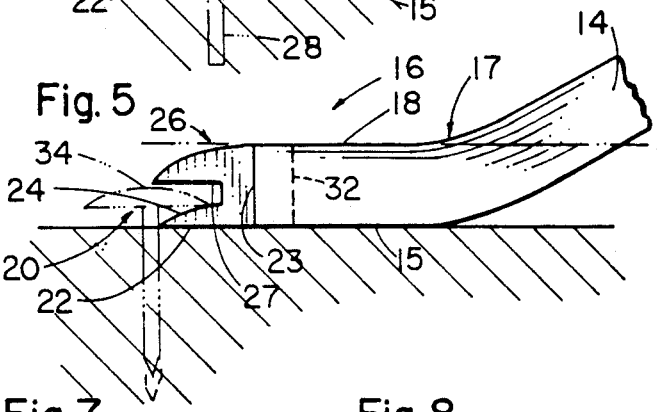
FIG. 5 is a side view of the working tip removing an upholstery tack.

Both lower claws 20A, 20B have a flat bottom 22 that is coplanar with the flat bottom 15 of shank 14 as best shown in FIGS. 4 and 5. Significantly, the leading edge 25 of claws 20A, 20B is very thin, i.e., each claw has a feather edge. This inventive feature enables the facile insertion of claws 20A, 20B under a staple crown without tearing the fabric. Claws 20A, 20B have a generally arcuate upper surface 24, best shown in FIGS. 1, 4 and 5, that allows the crown of the staple to easily slide along the extent thereof from said feather edge. Thus, the crown of the staple enters into horizontal slot 31 that separates lower claws 20A, 20B, from upper claws 26A, 26B. The depth of horizontal slot 31 is best shown in FIGS. 1, 4 and 5.

Said feather edge 25 of each claw 20A, 20B is slid under the crown of the staple 20A to be extracted and the tool is pivoted about bend 17 as indicated by the directional arrow 30 in FIG. 4.

Figure 6:
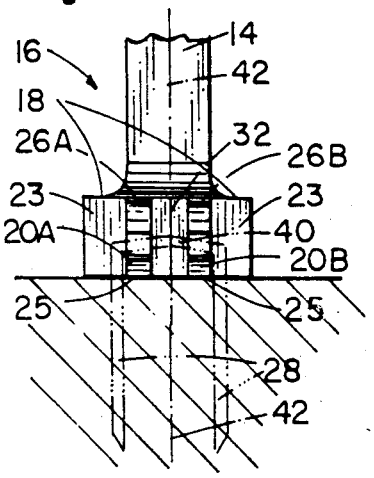
FIG. 6 is a front elevational view of the working tip removing a staple.

The crown will not buckle to any extent whatsoever when the tool is pivoted, because, as is clearly shown in FIG. 6, the lateral spacing of lower claws 20A, 20B is only slightly less than the breadth of the crown; accordingly, the crown is firmly supported at its opposite ends during the extraction procedure, and for that reason crown buckling is an impossibility as those skilled in the mechanical arts will appreciate.

FIG. 6 depicts the use of the novel tool 10 on a staple that has already been buckled by a tool of the prior art. Since staples are driven in by power tools that impact the staple at the opposite ends of the crown, i.e., in alignment with the staple legs, the staples are quite weak at the points where the crown is bent to form the legs. Thus, any bending or buckling of the crown by any appreciable amount will result in a broken staple.

The present inventive construction, for the first time anywhere in the world, provides a means that even permits an already buckled crown from breaking; as shown in FIG. 6, the flat, lower surfaces 27 of upper claws 26A, 26B provide a stop means which severely limits the amount of buckling of the crown that may occur.

Figure 7:
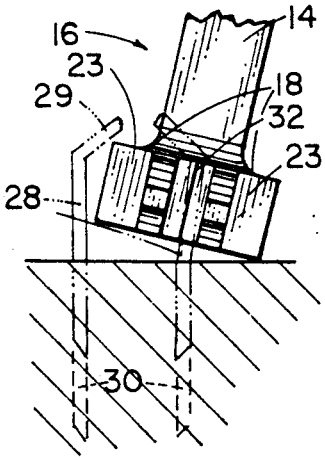
FIG. 7 is a front elevational view of the working tip removing a broken staple.

Such stop means cooperates with the lower claws 20A, 20B to capture each half of the crown in a wedging or pinching action as depicted in FIG. 6. More particularly, it should be observed in FIG. 6 that the flat lower surfaces 27 of the upper claws 26A, 26B abuttingly engage the top surface 40 of staple 28 at the same time that the arcuate upper surfaces of the lower claws 20A, 20B abuttingly engage the bottom surface 42 of the staple immediately adjacent the staple legs as shown. Thus, the staple crown is engaged at four laterally spaced apart points and even under the worst situation where a weak staple has been power driven into very hard wood and an attempt has been made to extract it with a tool of the prior art, thereby causing the crown to buckle as shown in FIG. 6, the novel tool can still extract the staple in one piece and without causing further damage to the staple holes.

Where a prior art tool has already broken the crown of a staple, tool 10 can extract the separate legs one at a time by engaging a leg in the manner depicted in FIG. 7 and laterally pivoting the tool as shown, without further damage to the holes. Thus, flat part 21 of a wing 18 becomes the fulcrum for the lever action that pulls the staple leg out without causing further damage as aforesaid. The staple leg is received, as shown, by vertical slot 32 that separates the bifurcated upper claws 26A, 26B from one another and the bifurcated lower claws 20A, 20B, from one another as well. Vertical slot 32 has a greater depth than horizontal slot 31 as is clear from the drawings. This allows a staple leg to enter deeply into said slot 32 when a job of the type depicted in FIG. 7 is undertaken.

Figure 8:
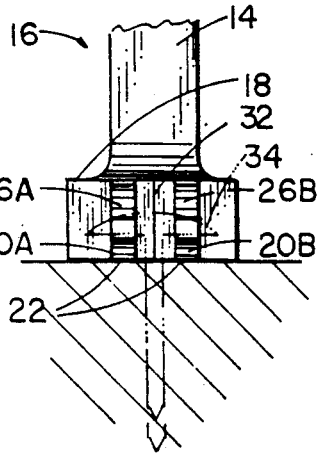
FIG. 8 is a front elevational view of the working tip removing an upholstery tack.

Tacks or nails are removed in substantially the same way as staples as depicted in FIGS. 5 and 8. As shown in FIG. 8, the head of a tack or nail is firmly supported by the lower claws 20A, 20B on opposite side of the shank of the nail, thereby substantially insuring that the head will not bend or break off and that the shank will be extracted in a direction coincident with its axis of symmetry, i.e., a center line thrust will be imparted to the shank when the tool is pivoted as suggested in FIG. 8, thereby assuring that the hole will not be enlarged or otherwise deformed.

Having taken an overview of the mechanical structure of the novel tool, a meaningful look at some of its important structural features can now be undertaken.

Figure 2:
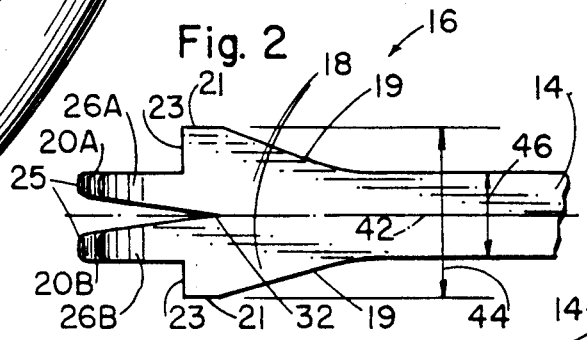
FIG. 2 is a top plan view of the working tip thereof.

It should first be noted that tool 10 has a longitudinal axis of symmetry 42 and that it exhibits bilateral symmetry with respect thereto. The flat end walls 23 of wings 18 are orthogonal to said longitudinal axis of symmetry and slot 32 extends proximal of said flat end walls; the proximal end of a horizontal slot that separates the upper and lower claws is distal of said flat end walls. It is also important to note that the collective breadth or transverse extent 44 of the wing members 18 is twice the breadth 46 of shank 14, as is best shown in FIG. 2. Moreover, as best observed by comparing FIGS. 2 and 4, the thickness 48 of shank 14 is equal to the breadth 46 of said shank and the wings 18 have the same thickness 48. The collective breadth of the upper and lower pair of claws is equal to twice the breadth 46 of shank 14, i.e., wings 18, 18 flare laterally outwardly along their respective two distal extents, until the breadth of the shank 14 has doubled. The aforementioned flat edge walls 21 have a short longitudinal extent and the wings then terminate. Importantly, the claws that continue distally thereof have a collective breadth equal to the breadth 46 of shank 14, which breadth is only slightly less than the transverse extent that separates the legs of a staple so that the crown of the staple is supported at its opposite ends by the lower pair of claws as aforesaid during the extraction procedure. It should also be observed that the vertical slot 32 that separates the claws of the upper pair of claws from one another and that separates the claws of the lower pair of claws from one another begins proximally of flat end walls 23 and progressively widens along the longitudinal extent thereof as best shown in FIGS. 1 and 2 so that the leg of a staple is wedgingly received therebetween as depicted in FIG. 7 and so that the shank of a tack is similarly received therebetween as depicted in FIG. 8. The horizontal slot that separates the upper pair of claws from the lower pair begins distally of said wing end walls 23 and has a flat top 27. The proximal end of such horizontal slot has a depth or thickness at least slightly greater than the thickness of a crown of a staple to fully slidingly receive the same therein as depicted in FIG. 4.

Finally, it should be clear from FIG. 8 that if a tack or nail is unusually long, the lower claws can be used to partially extract it, and then the upper claws can be used to fully extract it by placing the elongate shank in the vertical slot 32, positioning the upper surface of the upper claws in underlying relation to the lower surface of the head of the tack or nail, and pivoting the tool in the direction of arrow 30 in FIG. 4 to complete the extraction.

This tool, to be known commercially as the Grabber (TM), represents the culmination of the art of extractor tools and the claims which follow are therefore to be broadly interpreted.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A hand tool, comprising:

a handle;

an elongate, rigid shank fixedly secured to said handle and extending longitudinally therefrom;

a single gradual bend having a predetermined angle being formed in said shank near a distal free end thereof;

a first pair of transversely spaced apart claw members being integrally formed at the distal free end of said shank and extending longitudinally therefrom, said first pair of claw members having a common predetermined longitudinal extent;

a second pair of transversely spaced apart claw members being integrally formed at the distal free end of said shank and extending longitudinally therefrom, said second pair of claw members having a common predetermined longitudinal extent greater than the longitudinal extent of said first pair of claw members;

said first and second pair of claw members being vertically spaced apart from one another, said first pair of claw members being disposed above said second pair of claw members when said tool is being used;

each claw member of said second pair of claw members having a flat bottom surface;

a first claw member of said first pair of claw members and a first claw member of said second pair of claw members being disposed in a common plane;

a second claw member of said first pair of claw members and a second claw member of said second pair of claw members being disposed in a common plane;

said shank flaring laterally outwardly distal of said bend formed therein in a manner that increases width as distance from said bend increases, said outward flaring forming a pair of wing members having bilateral symmetry;

each of said wing members having a flat end wall that lies in a plane orthogonal to the longitudinal axis of symmetry of said tool;

each of said wing members having a flat upper surface and a flat bottom surface;

said flat bottom surface of each of said wing members being coplanar with the flat bottom surfaces of each of said second pair of claw members;

a longitudinally extending flat being formed on an outermost edge of each wing member; and said shank and said wing members having a common thickness.

2. The tool of claim 1, wherein both of said wing members have flat distal ends that lie in a plane orthogonal to the longitudinal axis of symmetry of said tool.

3. The tool of claim 2, wherein said first and second pairs of claw members have a common breadth.

4. The tool of claim 3, wherein said common breadth is slightly less than the breadth of the crown of a staple so that the crown of a staple is supported at its opposite ends by said second pair of claw members when a staple is extracted from a substrate by said tool.

5. The tool of claim 4 wherein said collective breadth is substantially equal to the breadth of said shank of said tool.

6. The tool of claim 5, wherein said predetermined angle of said gradual bend is about thirty degrees.

7. The tool of claim 5, wherein said shank and said wing members have a common thickness, wherein an upper surface of said first pair of claw members is coincident with an upper surface of said wing members and wherein a lower surface of said second pair of claw members is coincident with a lower surface of said wing members.

8. The tool of claim 7, wherein the transverse extent of said wing members is twice a transverse extent of said shank.

9. The tool of claim 8, wherein the common thickness of said shank and said wing members is equal to the transverse extent of said shank.

10. The tool of claim 9, wherein a vertical slot coincident with said longitudinal axis of symmetry of said tool is formed in said wing members, said slot bifurcating the distal end of said tool so that the claw members of said first pair of claw members are transversely spaced apart from one another and so that the claw members of said second pair of claw members are transversely spaced apart from one another.

11. The tool of claim 10, wherein said vertical slot progressively widens along its longitudinal extent from its starting point, said starting point being proximal of the flat end walls of said wing members.

12. The tool of claim 11, further comprising a horizontally disposed slot that separates said first pair of claw members from said second pair of claw members, said horizontally disposed slot having a point of beginning distal to the flat end walls of said wing members.

13. The tool of claim 12, wherein said horizontally disposed slot has a flat top defined by the lower surfaces of said first pair of claw members, and wherein said horizontally disposed slot is specifically dimensioned to accommodate the crown of a staple.

14. The tool of claim 13, wherein said shank has a square transverse cross section.

* * * * *